US006572096B1

(12) United States Patent
Johnson et al.

(10) Patent No.: US 6,572,096 B1
(45) Date of Patent: Jun. 3, 2003

(54) IMAGE FORMING DEVICE HAVING A CLOSED-LOOP FEEDBACK SYSTEM

(75) Inventors: Bruce G. Johnson, Vancouver, WA (US); Pete Gysling, New Plymouth, ID (US)

(73) Assignee: Hewlett-Packard Development Company, L.P, Houston, TX (US)

( * ) Notice: Subject to any disclaimer, the term of this patent is extended or adjusted under 35 U.S.C. 154(b) by 48 days.

(21) Appl. No.: 09/996,696

(22) Filed: Nov. 30, 2001

(51) Int. Cl.[7] ..... B65H 5/22; B65H 83/00; B65H 85/00; B65H 5/00; B65H 7/08

(52) U.S. Cl. ..... 271/25; 271/3.15; 271/10.02; 271/4.02

(58) Field of Search ..... 271/25, 3.15, 4.02, 271/10.02, 4.1, 31, 38, 152, 158, 265.01, 3.13, 110, 227, 270; 700/228, 230; 198/502.4, 341.1; 399/396

(56) References Cited

U.S. PATENT DOCUMENTS 5,435,537 A * 7/1995 Gysling ..... 271/10.05
5,549,402 A * 8/1996 Yamaguchi ..... 400/708

FOREIGN PATENT DOCUMENTS

DE 43 23 091 A 1 * 12/1995 ..... B41F/33/06
JP 2002-226085 * 8/2002 ..... B65H/7/02

* cited by examiner

*Primary Examiner*—Donald P. Walsh
*Assistant Examiner*—Kenneth W. Bower

(57) ABSTRACT

A media advance device includes a pick roller and a pair of sensors. The first sensor may be an encoder utilized to determine the speed of media advance. In addition, data from the first sensor and/or the second sensor may be utilized in a closed loop feedback system to alter the time in which an error signal may be returned according to the level of the media in the media tray. In addition, the speed of the media advance may be varied in real time to compensate for variations in the time intervals required to advance sheets of media from the media tray to the second sensor. By virtue of the detected speed of media advance as sensed by the first sensor and/or the second sensor, the level of media in the media tray may be calculated in a substantially accurate manner.

21 Claims, 5 Drawing Sheets

IMAGE FORMING DEVICE HAVING A CLOSED-LOOP FEEDBACK SYSTEM

FIELD OF THE INVENTION

This invention relates generally to a media feeding apparatus for image forming devices. More specifically, the present invention relates to a closed-loop feedback control system for a media feed apparatus.

BACKGROUND OF THE INVENTION

Image forming devices, e.g., printers, copiers, facsimile machines, and the like typically include a media tray configured to store at least one sheet of media (e.g., paper, textiles, mylar, and the like) to be fed into the image forming device during an image forming operation. Some image forming devices employ a feed arm assembly to actuate the feeding of a sheet of media from the media tray. The feed arm assembly may include a feed arm pivotally attached at a position generally above the media tray and a pick roller configured to contact and advance a sheet of media by operation of its rotation. At least by virtue of the pivoted attachment of the feed arm, as the level of media in the media tray decreases, the feed arm typically rotates to thereby substantially maintain contact between the pick roller and a top sheet of media in the media tray.

Conventional image forming devices may also include a sensor located generally upstream of a pair of pinch rollers. The sensor is typically configured to be tripped as a sheet of media is fed from the media tray and into the pinch rollers. When the sensor is tripped or some time shortly thereafter, the pick roller is oftentimes deactivated such that the sheet of media may be advanced into the image forming device by operation of the rotation of the pinch rollers. The sensor is also typically provided to determine whether an error in the media advancement has occurred, e.g., a paper jam. In one respect, a predetermined time interval may be set for a sheet of media to be advanced from the media tray to the sensor. An error signal may be displayed when a sheet of media has not advanced to the sensor within the predetermined time interval. However, as the sheets of media are advanced into the image forming device, the level of the media within the media tray decreases, thus increasing the amount of time necessary for a sheet of media to trigger the sensor. The range in the amount of time necessary for sheets of media to trigger the sensor based upon the height of the media in the media tray generally increases the complexity of detecting the occurrences of media advancement errors.

In one respect, some media tray devices attempt to overcome the above-described problem by employing a spring-loaded device to maintain the sheets of media in the media tray at a substantially constant height. One drawback of these types of media tray devices is that they are relatively complex compared to non-lifting type media trays. Another drawback is that they typically must be removed from an image forming device in order for the supply of media to be replenished in the media tray.

SUMMARY OF THE INVENTION

According to one aspect, the present invention pertains to a device having a feed arm assembly and an idler roller. The feed arm assembly includes a first end and a second end. The first end is pivotally connected to a substrate at a pivot point. The second end includes a pick roller configured to cause a sheet of media to advance along a feed path. In addition, an idler roller containing a sensor is connected to the feed arm assembly. The sensor is configured to monitor the advancement of the sheet of media.

According to another aspect, the present invention relates to a method for feeding media sheets. In the method, a pick roller of a feed arm assembly is activated to thereby cause a sheet of media to travel along a feed path. By virtue of the travel of the sheet of media and the substantial contact between an idler roller and the sheet of media, the idler roller containing a sensor is caused to rotate. The rotation of the idler roller may be sensed to determine the speed of media advance. In addition, a closed-loop feedback of media advance along the feed path may be formed by sensing the rotation of the idler roller.

In one respect, the closed-loop feedback of media advance is implemented to alter the time to return an error signal.

In another respect, the closed-loop feedback of media advance is implemented to alter the speed at which the sheets of media advance along the feed path.

In yet another respect, the closed-loop feedback of media advance is implemented to calculate the level of media in a media tray.

According to yet another aspect, the present invention pertains to a computer readable storage medium on which is embedded one or more computer programs, where the one or more computer programs implement a method for feeding media sheets. The one or more computer programs include a set of instructions for activating a pick roller of a feed arm assembly to thereby cause a sheet of media to travel along a feed path, where the manipulation of the sheet of media is operable to cause an idler roller containing a sensor to rotate. The one or more computer programs further include a set of instructions for determining the speed of the media advance. In addition, the one or more computer programs further include a set of instructions for forming a closed-loop feedback of media advance along the feed path.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to an exemplary embodiment thereof, particularly with references to an example of a media tray and a media feed arm assembly. However, one of ordinary skill in the art would readily recognize that the same principles are equally applicable to, and can be implemented in, any type of reasonably suitable media advance device, and that any such variation would be within such modifications that do not depart from the true spirit and scope of the present invention.

Figure 1:
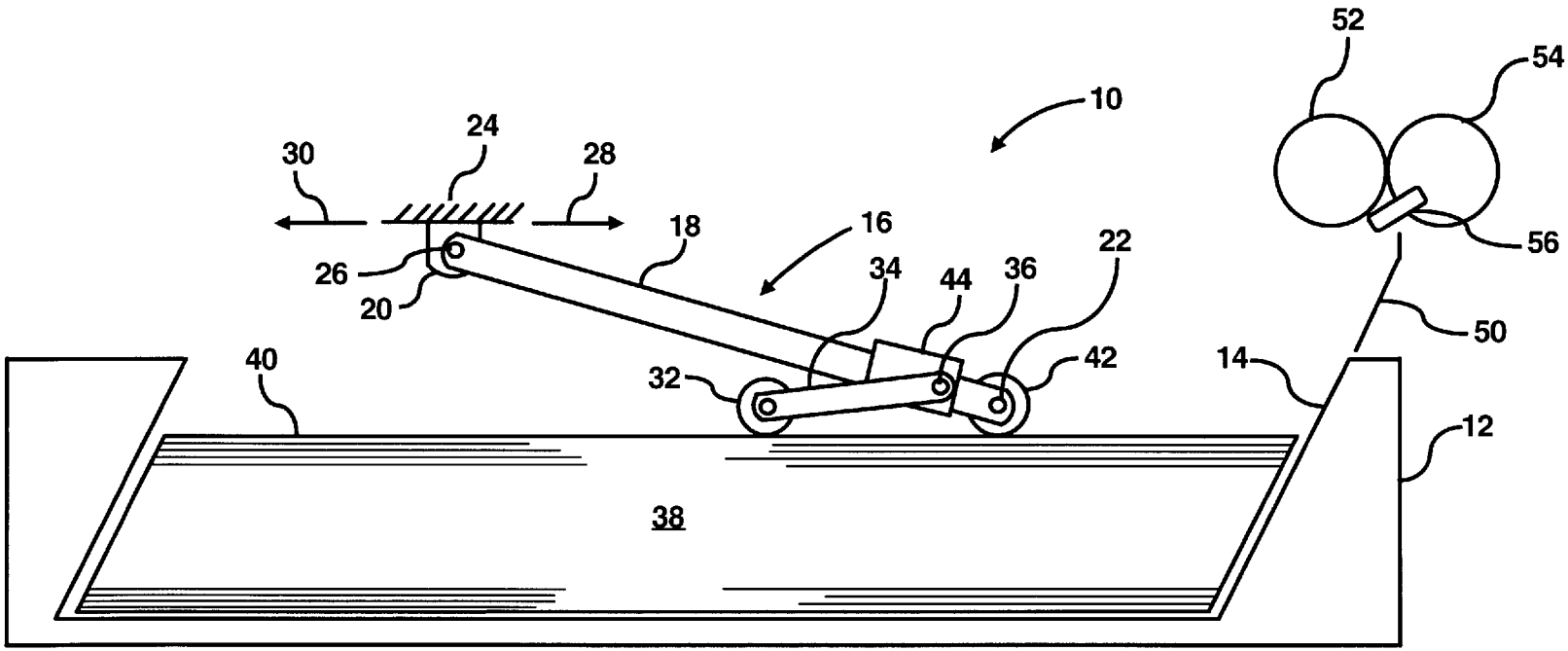
FIG. 1 illustrates a schematic side view of a media advance device in accordance with an embodiment of the present invention.

FIG. 1 illustrates a media advance device 10 in accordance with an embodiment of the present invention. The media advance device 10 includes a media tray 12 having a singulation ramp 14 and a feed arm assembly 16. The feed arm assembly 16 includes a feed arm 18 having a first end 20 and a second end 22. The first end 20 of the feed arm 18 is pivotally connected to a substrate 24 at a pivot point 26. A pivoting mechanism may be provided to enable the feed arm 18 to be pivoted at the pivot point 26. The pivoting mechanism may include any reasonably suitable mechanism or pair of mechanisms, such as, a hinge arrangement, a mating hole and rod assembly, and the like. A pick roller 42 is rotatably connected to the second end of the feed arm 18. The outer surface of the pick roller 42 is preferably comprised of a rubber or a rubber-like material.

As the level of media 38 increases or decreases, the feed arm 18 rotates about the pivot point 26 and maintains the pick roller 42 in substantially constant contact with the top sheet 40 of media 38. The pick roller 42 may be rotated by a roller motor 44. Although the roller motor 44 is illustrated as attached to the feed arm 18, the roller motor 44 may be positioned at any reasonably suitable position with respect to the pick roller 42. In addition, the roller motor 44 may comprise any reasonably suitable type of motor, e.g., direct current (DC) motor and the like.

The substrate 24 may include any reasonably suitable structure that is capable of substantially fixedly supporting the feed arm assembly 16. In addition, the position of the substrate 24 may also be manipulated with respect to the media tray 12 in directions 28 and 30. In this regard, the substrate 24 may include, for example, a cover (not shown) for the media tray 12, a section of an image forming device, and the like. In one respect, the position of the substrate 24 may be manipulated to accommodate for media 38 having various sizes and stiffnesses, e.g., index cards, letter size, A4 size, etc. In addition, the distance between the substrate 24 and the pick roller 42/idler roller 32 may also be varied to accommodate for media having various stiffnesses, e.g., lightweight and heavy weight sheets of media 38. The distance between the substrate 24 and the pick roller 42 may be altered in any reasonably suitable manner known to those skilled in the art, e.g., the feed arm 18 may be telescoping, the pick roller 42/idler roller 32 may be designed to slide along the feed arm 18, etc.

Attached to the feed arm 18 is the idler roller 32 via a connecting bar 34. At an end opposite the idler roller 32, a connecting bar pivot point 36 is provided to generally enable the connecting bar to pivot with respect to the feed arm 18. In this respect, any change in media 38 height and subsequent change in feed arm 18 angle, will not substantially affect the contact between the idler roller 32 and a top sheet 40 of media 38. The idler roller 32 comprises a wheel configured to rotate independently of the rotation of the pick roller 42. The outer surface of the idler roller 32 may comprise rubber or a rubber-like material to substantially rotate along with translation of the top sheet 40 of media 38. In this regard, by virtue of the contact between the idler roller 32 and the top sheet 40 of media 38, as the top sheet of media advances by rotation of the pick roller 42, the idler roller 32 is configured to rotate along with the forward progression of the top sheet 40 of media 38.

The idler roller 32 includes a sensor, e.g., an encoder, (not shown) to detect and monitor the forward advance of the top sheet 40 of media 38 regardless of whether the pick roller 42 is properly advancing the top sheet 40. Consequently, the rotation of the pick roller 42 may not necessarily result in the rotation of the idler roller 32, e.g., rotation of the pick roller 42 may not necessarily result in forward advance of the top sheet 40 of media 38 due to slippage. Thus, the sensor in the idler roller 32 may substantially accurately detect and monitor the advancement of the top sheet 40 of media 38 independently of the pick roller 42 rotation.

The sensor included within the idler roller 32 may comprise any reasonably suitable type of sensor. In this regard, the sensor may comprise any reasonably suitable device configured to translate rotary motion into an electronic signal. Examples of suitable sensors include a sensor and a magnet, a light emitting diode, a rotary encoder, and the like. In general, the sensor may be selected according to a variety of factors including size, resolution, cost, and the like. In addition, the electronic signal created by the sensor may be designed for interpretation by an electronic device, such as, a microprocessor.

Although the idler roller 32 is illustrated as positioned behind the pick roller 42, it should be understood that the idler roller may be positioned at various other positions with respect to the pick roller. For example, the idler roller 32 may be positioned along side the pick roller 42 or it may be positioned in front of the pick roller. Thus, the representative illustration of the media advance device 10 in FIG. 1 depicts only one of many various configurations possible in accordance with the principles of the present invention.

Along the media feed path, i.e., the path of media advance, a singulation ramp 14 is provided to generally separate the top sheet 40 from the stack of media sheets 38 during the advancement of the top sheet of media. In this respect, as the top sheet 40 of media 38 is advanced and contacts the singulation ramp 14, the angle of the singulation ramp may cause the sheet of media to bow, thereby causing an air gap between the top sheet 40 and an adjacent sheet. The air gap may then cause a break in the adhesion between the top sheet 40 and the adjacent sheet, thereby causing the top sheet 40 to be separated from the adjacent sheet. The amount of bow in the top sheet 40 is generally relative to the weight of the media, i.e., relatively lightweight media will typically bow more than relatively heavy media.

Further along the media feed path, a media guide 50 may be provided between the singulation ramp 14 and a pair of pinch rollers 52 and 54. The pinch rollers 52 and 54 are generally provided to advance a sheet of media from the media tray 12 and into the image forming device. A sensor flag 56 is located generally upstream of the pinch rollers 52 and 54 and generally operates to detect insertion of a sheet of media into the pinch rollers 52 and 54. Typically, once a sheet of media 38 triggers the sensor flag 56 or some time shortly thereafter, e.g., to generally enable the pinch rollers 52 and 54 to substantially contact the sheet of media 38, the pick roller 42 may be deactivated and the sheet of media may be advanced to the image forming device by operation of the pinch rollers 52 and 54.

Figure 2:
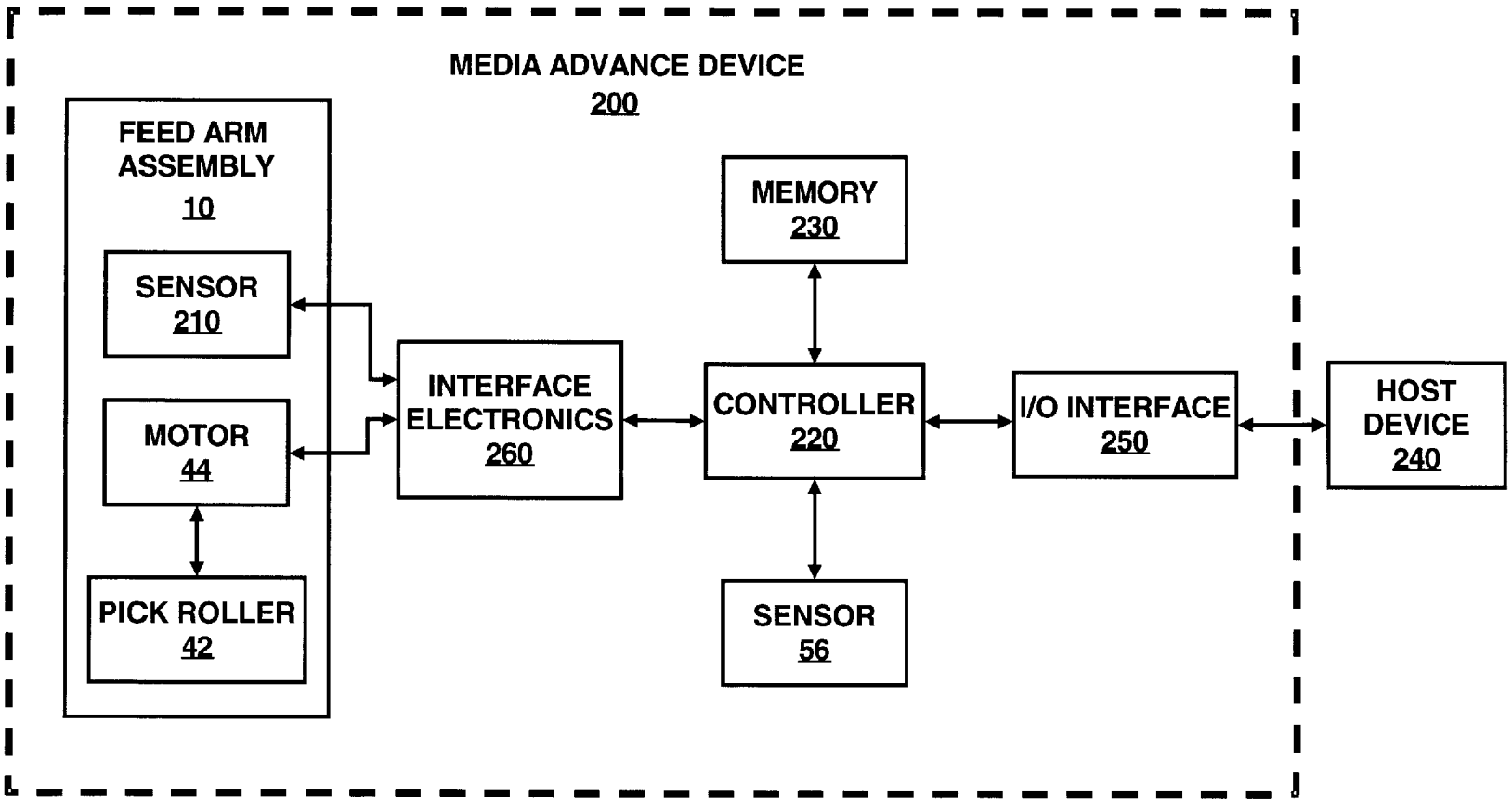
FIG. 2 illustrates an exemplary block diagram of a media advance device in accordance with an embodiment of the present invention.

Referring to FIG. 2, there is illustrated an exemplary block diagram of a media advance device 200 in accordance with an embodiment of the present invention. The following description of the exemplary block diagram illustrates one manner in which a media advance device 200 having a feed arm assembly 10 may operate, in accordance with one embodiment of the present invention. In this respect, it is to be understood that the following description of the exemplary block diagram is but one manner of a variety of different manners in which the media advance device 200 of the present invention may be operated.

The pick roller 42 may be rotated by operation of a motor 44. The pick roller 42 is configured to substantially contact a top sheet of media, such that, rotation of the pick roller 42 is operable to cause a top sheet of media to advance toward an image forming device. The top sheet of media is configured to receive a particular image (e.g., picture, text, diagrams, etc.) while positioned within the image forming device.

A controller 220 may be configured to provide control logic for the feed arm assembly 10. In this respect, the controller 220 may possess a microprocessor, a microcontroller, an application specific integrated circuit, or the like. The controller 220 may be interfaced with a memory 230 configured to provide storage of a computer software that provides the functionality of the media advance device 200 and may be executed by the controller. The memory 230 may also be configured to provide a temporary storage area for data/file received by the media advance device 200 from a host device 240, such as a computer, server, workstation, image forming device, and the like. The memory 230 may be implemented as a combination of volatile and non-volatile memory, such as dynamic random access memory ("RAM"), EEPROM (electronically erasable programmable read-only memory), flash memory, and the like. Alternatively, the memory 230 may be included in the host device 240.

The controller 220 may also be configured to accept data from the sensor flag 56. In this respect, the controller 220 may receive data from the sensor flag 56, e.g., the amount of time between triggers. In addition, the controller 220 may utilize the data received from the sensor flag 56 to determine whether errors in the media advance have occurred.

The controller 220 may further be interfaced with an I/O interface 250 configured to provide a communication channel between the host device 240 and the media advance device 200. The I/O interface 250 may conform to protocols such as RS-232, parallel, small computer system interface, universal serial bus, etc. In addition, the controller 220 may be interfaced with the motor 44 and the pick roller 42.

The media advance device 200 may also include interface electronics 260 configured to provide an interface between the controller 220 and components (not shown) for manipulating the motor 44 and for receiving data from a sensor 210.

Figure 3:
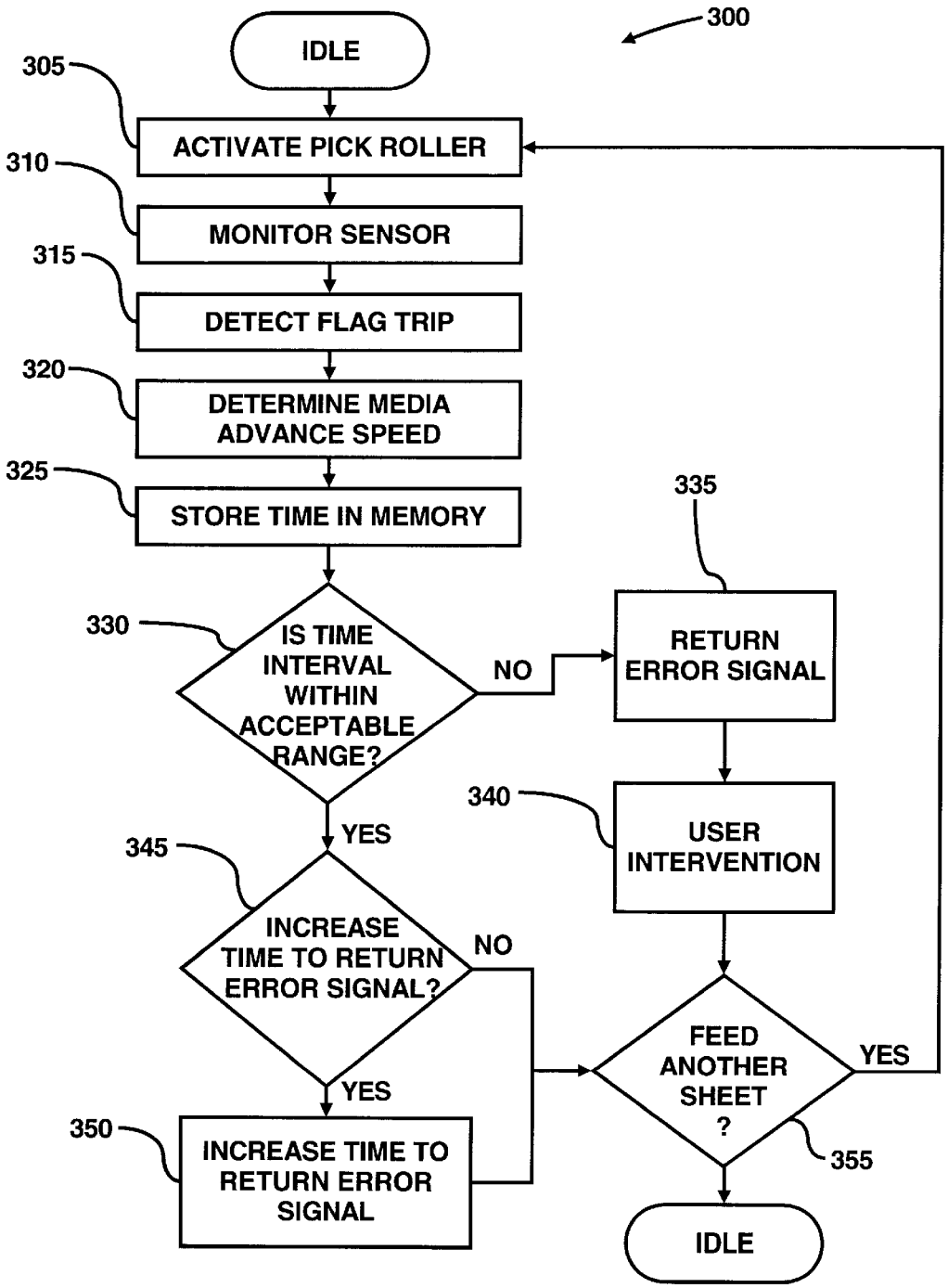
FIG. 3 illustrates an exemplary flow diagram of a method by which an embodiment of the present invention may be practiced.

With reference now to FIG. 3, there is illustrated an exemplary flow diagram 300 of a method by which an embodiment of the present invention may be practiced. The following description of the method 300 is made with reference to the exemplary block diagram illustrated in FIG. 2, and thus makes reference to the elements illustrated therein. The steps in the exemplary method 300 may be contained as a program or subroutine embedded in any desired computer accessible medium. Such medium include the memory 230, internal and external computer memory units, and other types of computer accessible media, such as a compact disc readable by a storage device. In addition, the flow diagram 400 may be performed by a computer program, which can exist in a variety of forms both active and inactive. For example, they can exist as software program(s) comprised of program instructions in source code, object code, executable code or other formats. Any of the above can be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. Although particular reference is made in the following description of FIG. 3 to the controller 220 as performing certain printer functions, it is to be understood that those functions may be performed by any electronic device capable of executing the above-described functions.

At step 305, the pick roller 42 may be activated by the controller 220, for example, when the controller receives a command from the image forming device to advance a sheet of media. In this respect, the controller 220 may cause power to be supplied to the motor 44, thus causing the pick roller 42 to rotate. As the pick roller 42 rotates, by virtue of its contact with a top sheet of media, the media may be caused to advance along a feed path toward the sensor 56. In addition, as the sheet of media advances, by virtue of its contact with the idler roller, the sensor 210 may become activated, i.e., begin to rotate. At step 310, the rotation of the sensor 210 may be monitored, for example, to determine whether the sheet of media is properly advancing toward the sensor 56. Once a leading edge of the sheet of media reaches the sensor 56, a flag may be triggered in the sensor 56. The triggering of the flag in the sensor 56 may be relayed to the controller 220 at step 315. At this time or some time shortly thereafter, the controller 220 may cease the supply of power to the motor 44 to thus cause the pick roller 42 to stop rotating. In addition, the controller 220 may cause the pinch rollers 52 and 54 to begin to rotate to further advance the sheet of media.

At step 320, the controller 220 may determine the speed of media advancement. In one respect, the media advance speed may be determined from sensing the rotation of the sensor 210. In another respect, the media advance speed may be computed by determining the time interval from the start of sensor 210 rotation and the time the sensor 56 detected the leading edge of the sheet of media. This time interval may be stored in the memory 230, at step 325. In certain instances, if the time interval exceeds a predetermined maximum time interval, an error message, e.g., "paper-jam", may be returned and indicated to a user, thus requiring user intervention. However, according to the method 300, the predetermined maximum time interval may be altered to compensate for the media level in the media tray. For example, because it is generally known that sheets located near the bottom of the media tray must travel a greater distance compared to sheets located closer to the top of the media tray, the predetermined maximum time interval may be increased when the media level is detected to be closer to the bottom of the media tray. In addition, the level of media in the media tray itself may be calculated based upon the time interval between activation of the sensor 210 and the triggering of the sensor 56. In this respect, another error message, e.g., "low paper", may be returned when the calculated level of media reaches a certain pre-selected level.

At step 330, it may be determined whether the detected time interval is within an acceptable range. That is, for example, whether the time interval required to advance the sheet of media is within a certain range of normal operating conditions. The normal operating conditions may include those set by an image forming device manufacturer or it may be adaptive according to the time interval required to advance a previous set of media sheets. For example, the controller 220 may access a stored set of time intervals for a certain set of media sheets, e.g., five, ten, or more sheets, to determine the time interval a current media sheet should require in triggering the sensor 56. If the time interval for the current media sheet advancement exceeds this time, an error signal may be returned at step 335. User intervention (step 340) may be required to correct a problem indicated by the error signal.

At step 345, if the time interval is within the acceptable range, the controller 220 may determine whether it is necessary to increase the time to return an error signal. According to a preferred embodiment, as stated hereinabove, the time intervals for feeding a set of consecutively advanced sheets may be determined and stored. Based upon the stored time intervals, the time interval for returning an error signal may be increased. In one respect, for example, if the time interval for advancing the previous ten sheets took approximately 1.5 seconds, the controller 220 may increase the time to return an error signal by an additional 0.3 seconds to feed the next ten sheets. In this respect, the controller 220 may compensate for the decreased level of media in the media tray and the consequent additional time required to feed those sheets. If the time to return an error signal is not to be increased, then it is determined whether another sheet of media is to be feed at step 355.

If it is necessary to increase the time to return an error signal, at step 350, the controller 220 increases this time. Thus, if it is determined that another sheet of media is to be advanced into the image forming device 200 (step 355), the time interval allowed before an error signal may be returned is increased for the feeding of another sheet of media.

If another sheet of media is not to be advanced, the media advance device 200 may enter into an idle state, e.g., stand-by mode, sleep mode, shut down, etc.

In addition, the controller 220 may determine the level of media in the media tray based upon the determined time interval. By determining the time interval required to advance a sheet having a certain length at various heights within the media tray, a look up table (not shown) may be created to facilitate the determination of the media height. For example, a time interval of 1.8 seconds may correlate to the level of media equaling approximately half of the height of the media tray. In this respect, a substantially accurate determination of the media height may be determined based upon the detected time intervals for advancing the sheets of media.

Figure 4:
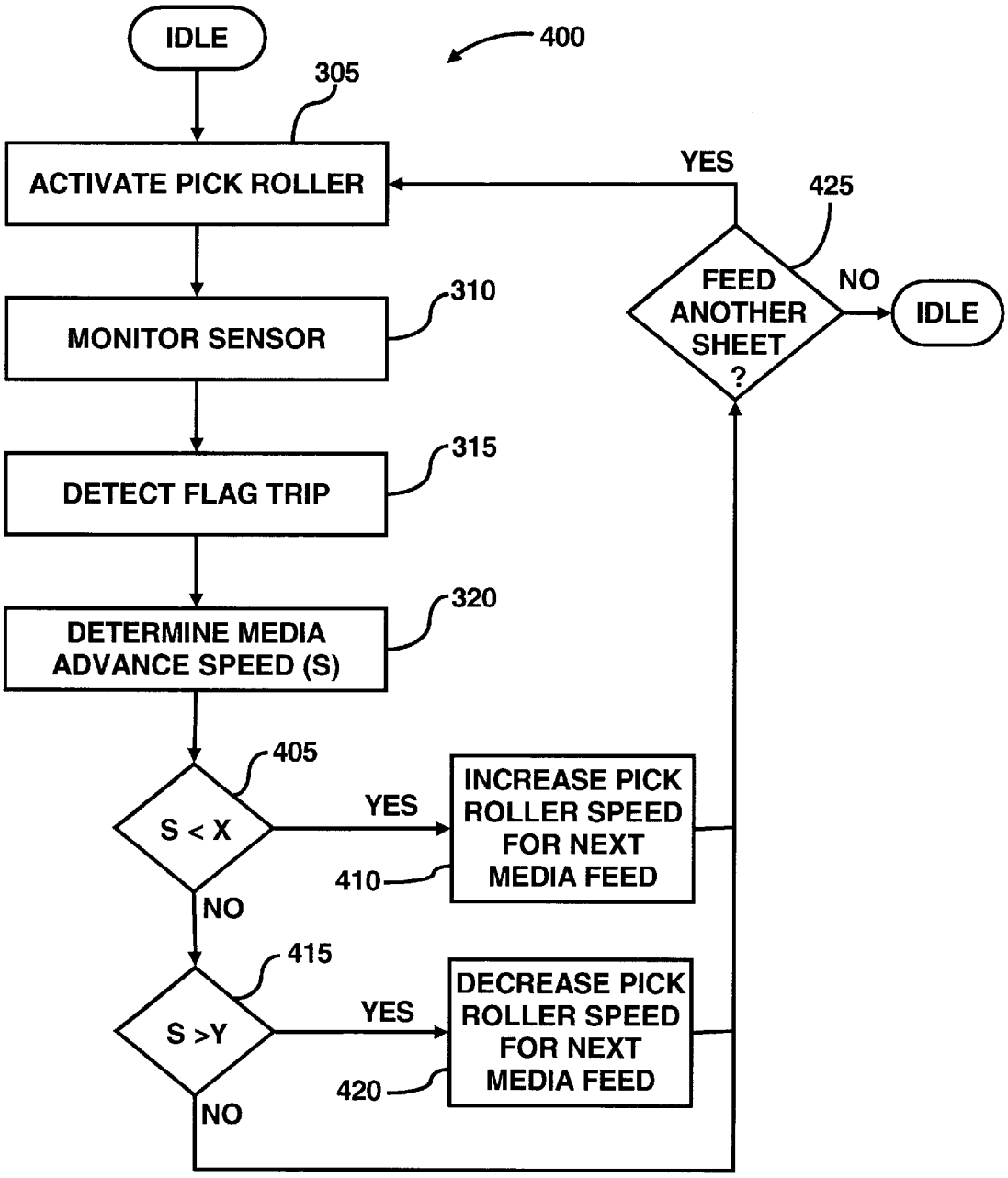
FIG. 4 illustrates an exemplary flow diagram of another method by which an embodiment of the present invention may be practiced.

With reference now to FIG. 4, there is illustrated an exemplary flow diagram of a method 400 by which an embodiment of the present invention may be practiced. The following description of the method 400 is made with reference to the exemplary block diagram illustrated in FIG. 2, and thus makes reference to the elements illustrated therein. It is to be understood that the steps illustrated in the exemplary method 400 may be contained as a program or subroutine in any desired computer accessible medium. Such medium including the memory 230, internal and external computer memory units, and other types of computer accessible media, such as a compact disc readable by a storage device. Thus, although particular reference is made in the following description of FIG. 4 to the controller 220 as performing certain functions of the media advance device, it is to be understood that those functions may be performed by any electronic device capable of executing the above-described functions.

In FIG. 4, steps 305–320 are identical to those described hereinabove with respect to FIG. 3 and thus will not be described in any additional detail. Beginning at step 405, the speed of the media advancement may be compared to a first predetermined speed value X, where X may correspond to a relative minimum speed for media advance. For example, if an image forming device is operating at about thirty pages per minute, a sheet of media should be fed at a rate of about every two seconds, which correlates to a certain speed depending on the length of the media. In this case, the first predetermined speed value X would be equal to a speed correlating to about two seconds. If the media advance speed is less than the first predetermined speed value X, the controller 220 may be set to increase the motor 44 speed by a calculated factor to cause the following sheet of media to be fed into the image forming device at a relatively faster rate at step 410.

If, at step 405, the media advance speed exceeds the first predetermined speed value X, the controller 220 may determine whether the media advance speed is greater than a second predetermined speed value Y at step 415. The second predetermined speed value Y may correspond to a relative maximum speed allowable for a sheet of media to be fed into the pinch rollers. For example, with reference to the above-recited example, if the image forming device is operating at about thirty pages per minute, the second predetermined speed value Y may correlate to about two seconds. In addition, Y may be equal to X or, Y may be relatively larger than X, to thereby allow a range of acceptable speed values. In this respect, the second predetermined speed value Y may be set to allow for relatively small variations in the media advance speeds. If the media advance speed exceeds the second predetermined speed value, the controller 220 may be set to decrease the motor 44 speed by a calculated factor to substantially cause the following sheet of media to be fed into the image forming device at a speed that substantially falls within the X and Y speed values, e.g., at a relatively slower speed, at step 420.

In one respect, the speed of media advance may be determined by sensing the rotation of the sensor 210. In another respect, the media advance speed may be computed by determining the time interval from the start of sensor 210 rotation and the time the sensor 56 detected the leading edge of the sheet of media. According to this example, the determined time interval may be compared to a first predetermined time interval which may correspond to a relative maximum time interval allowable for a sheet of media to be fed into the pinch rollers. In this respect, if the determined time interval exceeds the first predetermined time interval, the controller 220 may be set to increase the pick roller 42 speed by a calculated factor to substantially cause the following sheet of media to be fed into the image forming device at a relatively faster rate. Moreover, the determined time interval may be compared to a second predetermined time interval, which may correspond to a relative minimum time interval allowable for a sheet of media to be fed into the pinch rollers. In this respect, if the determined time interval falls below the second predetermined time interval, the controller 220 may be set to decrease the pick roller 42 speed by a calculated factor to substantially cause the following sheet of media to be fed into the image forming device at a relatively slower rate.

If the media advance speed is less than or equal to the second predetermined speed value, a determination of whether another sheet is to be fed into the image forming device may be made at step 425. In addition, step 425 may be performed following the above-described setting of the controller 220 to operate the motor 44 at a varied speed. Thus, when another sheet is to be fed (assuming that additional sheets of media are not inserted into the media tray in the interim), step 305 may be repeated, with the rotational speed of the pick roller 42 being set according to the results of steps 405–420. Otherwise, the image forming device may enter into an idle mode, e.g., stand-by, sleep, shutdown, etc.

Although not illustrated in the figures, the methods 300 and 400 may be separate operations or parts of a single operation. For example, an increase in the time to return an error signal may be implemented along with a decrease in the pick roller speed without deviating from the scope and spirit of the present invention.

Figure 5:
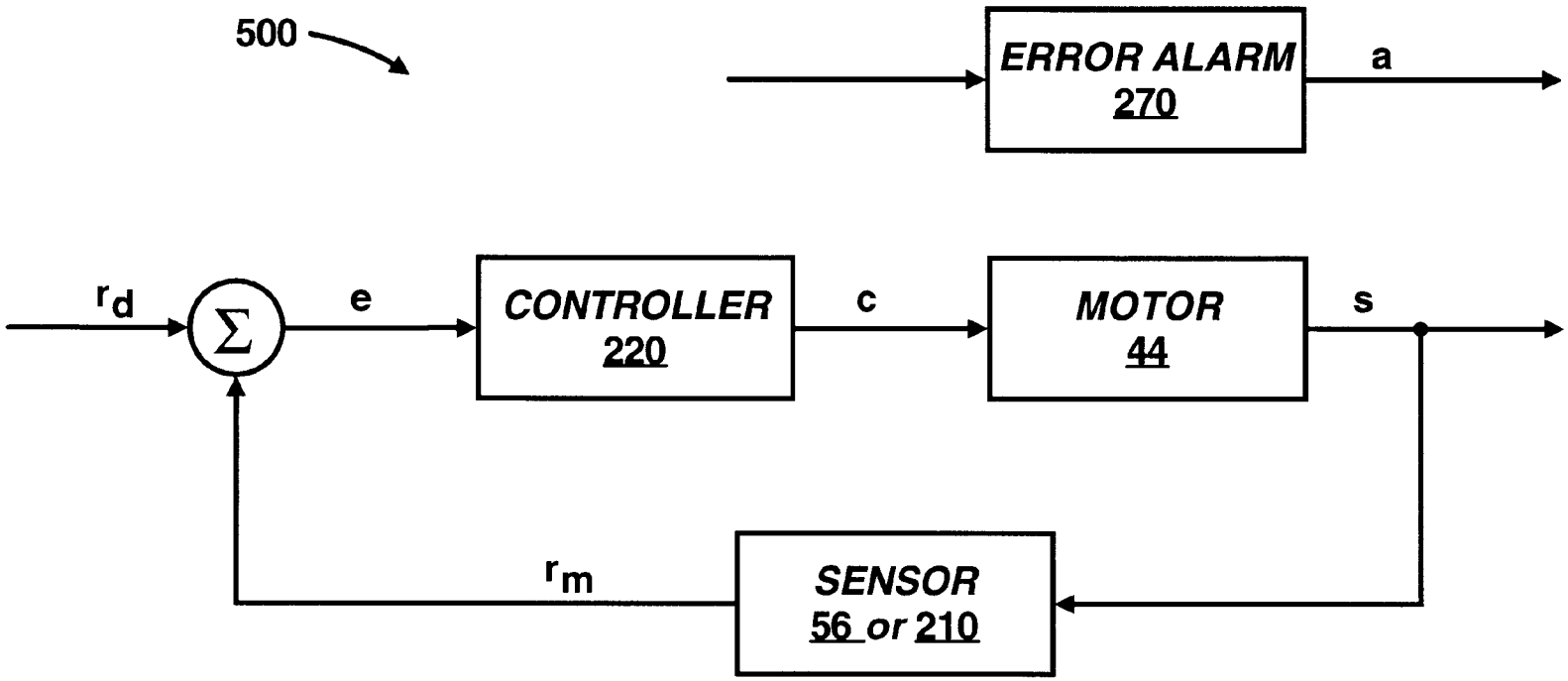
FIG. 5 illustrates a closed-loop feedback system according to an embodiment of the present invention.

In accordance with an embodiment of the present invention, a closed loop feedback system 500 between the controller 220, sensors 56,210 and the motor 44, and/or error alarm 270, is formed as illustrated in FIG. 5. The information detected by monitor of the sensors 56, 210 may be implemented by the controller 220 to vary the time in which an error signal may be returned by an image forming device. In addition, the closed loop feed back system may be implemented to alter speed of the media advance in real time to compensate for variations in the time intervals required to advance sheets of media from the media tray to the sensor. The closed-loop feedback system 500 illustrated in FIG. 5 illustrates a manner by which a closed-loop feedback system may be implemented to accomplish the above-stated embodiments of the invention.

In FIG. 5, "e" is the error signal, "s" is the media speed and "c" is the motor speed control signal. "rd" is the desired response time and "rm" is the measured response time, e.g., pick roller 42 turn off time—sensor 56 activation time. "a" is the alarm condition. By operation of the closed-loop feedback system 500, the speed of the motor may be varied to thereby vary the speed of media advance and the time to return an error signal may also be varied.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A device comprising:

a feed arm assembly having a first end and a second end, wherein said first end is pivotally connected to a substrate at a pivot point, and a pick roller is attached to said second end, and wherein rotation of said pick roller is configured to cause a sheet of media to advance along a feed path; and an idler roller containing a sensor, said idler roller being connected to said feed arm assembly, wherein said sensor is configured to monitor said advancement of said sheet of media.

2. The device according to claim 1, wherein said idler roller comprises a sensor housed within a wheel.

3. The device according to claim 2, wherein said idler roller is configured to rotate independently of said pick roller.

4. The device according to claim 2, wherein said idler roller is rotatably attached to one end of a connecting bar and the other end of said connecting bar is pivotally connected to said feed arm.

5. The device according to claim 1, wherein said feed arm assembly is connected to said substrate via a spring.

6. The device according to claim 1, wherein said idler roller is positioned generally upstream of said pick roller in the direction of said media advance.

7. The device according to claim 1, wherein a position of said pivot point is movable with respect to the direction of the advancing sheet of media to facilitate advancing of a sheet of media having various lengths and bending characteristics.

8. A method for feeding media sheets comprising:

activating a pick roller of a feed arm assembly to thereby cause a sheet of media to travel along a feed path, wherein said travel of said sheet of media is operable to cause an idler roller containing a sensor to rotate;

determining a speed of media advancement; and forming a closed-loop feedback detection system of advancing media along said feed path by sensing the rotation of the idler roller.

9. The method according to claim 8, further comprising:

utilizing the sensor to determine the speed of media travel along said feed path.

10. The method according to claim 8, further comprising:

detecting a first instance in time when said sensor begins to rotate;

detecting a second instance in time when said sheet of media triggers a flag in a second sensor located generally along said feed path; and determining a time interval between said first instance in time and said second instance in time.

11. The method according to claim 10, further comprising:

determining whether said time interval is within a predetermined acceptable range; and returning an error signal in response to said time interval falling outside said predetermined acceptable range.

12. The method according to claim 11, further comprising:

determining whether a time to return an error signal should be increased in response to said time interval falling within said predetermined acceptable range; and increasing said time to return an error signal in response to a determination that said time to return an error signal should be increased.

13. The method according to claim 12, further comprising:

increasing said predetermined acceptable range in response to detected time intervals for a set of previously fed media sheets.

14. The method according to claim 10, further comprising:

calculating a level of media in a media tray in response to the time interval between said first instance in time and said second instance in time.

15. The method according to claim 8, further comprising:

determining whether said speed of media advancement is less than a first predetermined speed value; and setting said pick roller to increase the speed of media advancement for a following sheet of media in response to said speed of media advancement being less than said first predetermined speed value.

16. The method according to claim 15, further comprising:

determining whether said speed of media advancement is greater than a second predetermined speed value in response to said speed of media advancement exceeding said first predetermined speed value; and setting said pick roller to decrease the speed of media advancement for a following sheet of media in response to said speed of media advancement exceeding said second predetermined speed value.

17. The method according to claim 16, further comprising:

determining whether another sheet of media is to be fed;

feeding another sheet of media in response to a requirement for feeding another sheet of media;

increasing the speed of the pick roller during feeding of said another sheet of media in response to said speed of media advancement being less than said first predetermined speed value; and decreasing the speed of the pick roller during feeding of said another sheet of media in response to said speed of media advancement exceeding said second predetermined time value.

18. A computer readable storage medium on which is embedded one or more computer programs, said one or more computer programs implementing a method for feeding media sheets, said one or more computer programs comprising a set of instructions for:

activating a pick roller of a feed arm assembly to thereby cause a sheet of media to travel along a feed path, wherein said travel of said sheet of media is operable to cause an idler roller containing a sensor to rotate;

determining a speed of media advancement; and forming a closed-loop feedback detection system of advancing media along said feed path by sensing the rotation of the idler roller.

19. The computer readable storage medium according to claim 18, said one or more computer programs further comprising a set of instructions for:

detecting a first instance in time when said sensor begins to rotate;

detecting a second instance in time when said sheet of media triggers a flag in a second sensor located generally along said feed path;

determining a time interval between said first instance in time and said second instance in time;

determining whether a time to return an error signal should be increased in response to said time interval falling within said predetermined acceptable range; and increasing said time to return an error signal in response to a determination that said time to return an error signal should be increased.

20. The computer readable storage medium according to claim 18, said one or more computer programs further comprising a set of instructions for:

determining whether said speed of media advancement is less than a first predetermined speed value;

setting said pick roller to increase the speed of media advancement for a following sheet of media in response to said speed of media advancement being less than said first predetermined speed value;

determining whether said speed of media advancement exceeds a second predetermined speed value in response to said speed of media advancement exceeding said first predetermined speed value; and setting said pick roller to decrease the speed of media advancement for a following sheet of media in response to said speed of media advancement exceeding said second predetermined speed value.

21. The computer readable storage medium according to claim 18, said one or more computer programs further comprising a set of instructions for:

detecting a first instance in time when said sensor begins to rotate;

detecting a second instance in time when said sheet of media triggers a flag in a second sensor located generally along said feed path;

determining a time interval between said first instance in time and said second instance in time; and calculating a level of media in a media tray in response to the time interval between said first instance in time and said second instance in time.

* * * * *